US006189839B1

(12) United States Patent
Lemieux

(10) Patent No.: US 6,189,839 B1
(45) Date of Patent: Feb. 20, 2001

(54) CANTILEVER GATE ARM

(76) Inventor: Don Lemieux, 12901 E. 99th St., North Owasso, OK (US) 74055

( * ) Notice: Under 35 U.S.C. 154(b), the term of this patent shall be extended for 0 days.

(21) Appl. No.: 09/596,847

(22) Filed: Jun. 19, 2000

(51) Int. Cl.[7] ..... B61L 23/00

(52) U.S. Cl. ..... 246/293; 246/473.1; 246/127; 49/13; 49/49

(58) Field of Search ..... 246/125, 126, 246/127, 272, 292, 293, 294, 473.1; 49/13, 49

(56) References Cited

U.S. PATENT DOCUMENTS

| | | | | |
|---|---|---|---|---|
| 1,385,787 | * | 7/1921 | Hryniewich | 246/293 |
| 1,533,722 | * | 4/1925 | Blackwell | 246/293 |
| 1,536,360 | * | 5/1925 | Stewart | 246/293 |
| 3,803,765 | | 4/1974 | Ritner | 49/427 |
| 3,952,978 | | 4/1976 | Reinitz | 246/477 |
| 3,964,704 | | 6/1976 | Karr | 246/125 |
| 4,666,108 | | 5/1987 | Fox | 246/125 |
| 4,844,653 | | 7/1989 | Dickinson | 404/6 |
| 4,922,655 | | 5/1990 | Seal | 49/131 |
| 5,008,967 | | 4/1991 | Barrios et al. | 14/7 |
| 5,118,056 | | 6/1992 | Jeanise | 246/127 |
| 5,669,588 | | 9/1997 | Goldsmith | 246/307 |
| 5,984,569 | | 11/1999 | Chou | 404/6 |
| 6,115,963 | * | 9/2000 | Allardyce et al. | 49/49 |

* cited by examiner

*Primary Examiner*—Mark T. Le
(74) *Attorney, Agent, or Firm*—Molly D. McKay

(57) ABSTRACT

A gate arm for retrofitting onto an existing cantilever crossing structure at a railroad crossing. The gate arm is pivotally attached to a mast of the existing cantilever crossing structure so that the gate arm can be lowered to an in use position and alternately raised to an out of use position. A cable extending from the gate arm to a winch secured to the cantilever crossing structure or mast lowers the gate arm in response to the approach of a train. Lights provided on the gate arm also activated in response to the approach of a train. The gate arm raises and the lights on the gate arm deactivated upon the train passing the crossing.

18 Claims, 3 Drawing Sheets

CANTILEVER GATE ARM

BACKGROUND OF THE INVENTION

1. Field of the Invention

The present invention relates to a gate arm for retrofitting onto an existing cantilever crossing structure that does not have a traffic control arm associated with it.

2. Description of the Related Art

Railroad crossings, i.e. where railroad tracks and vehicular roadways cross each other, present a unique threat to vehicles when the crossings are not properly marked. Gate arms that lower in front of vehicles when a train is approaching greatly decrease the chance of collisions between vehicles and trains at these crossings. Yet, many of these crossings currently only have cantilever crossing structures with flashing red lights and are not provided with gate arms that can be deployed in front of vehicles to prevent them from entering the crossing when a train is approaching the crossing. For safety reasons, it is desirable to have gate arms at all such crossings. Currently, the only way to achieve this is to add separate gate arms with new foundations, masts, electrical wiring and controls to supplement the existing cantilevers. These traffic control devices can be extremely expensive.

It would be much more economical to retrofit existing cantilever crossing structures that do not currently have a traffic control arm associated with them with a retractable gate arm. In order for an existing cantilever crossing structure to be retrofitted with a gate arm, the arm must be installed on the existing structure. Also, when the gate arm is in its downward position, i.e. when the traffic is stopped by the gate arm, the arm must be at the correct height above the ground to meet existing traffic control requirements for such traffic control gate arms. Another consideration is that the gate arm must, when in its raised position, i.e. when the traffic is not being stopped by the gate arm, be out of the path of the traffic so that required roadway height and width clearances are maintained.

The present invention addresses all of these needs by providing a cantilever gate arm that can be inexpensively retrofitted to an existing cantilever crossing structure. Further, the present invention provides a gate that can be deployed downward to a position that is the proper height to control vehicular traffic and can, alternately, be raised to a position that maintains the necessary roadway height and width clearances when the gate is not in use.

SUMMARY OF THE INVENTION

The present invention is a cantilever gate arm for retrofitting onto an existing cantilever crossing structure. The gate arm is pivotally attached to a mast of the existing cantilever crossing structure so that the gate arm can be lowered to an in use position and alternately raised to an out of use position. A winch is secured to the cantilever crossing structure and a cable extends from the winch to the gate arm as a means for raising and lowering the gate arm. The winch is electrically connected with the existing lights on the structure so that when the existing warning lights are activated, the winch lowers the gate to its in use position and activates lights that are provided on the gate arm and so that when the existing warning lights are deactivated, the winch again raises the gate to its out of use position even after the train has gone past.

DETAILED DESCRIPTION OF THE PREFERRED EMBODIMENT

The Invention

Figure 1:
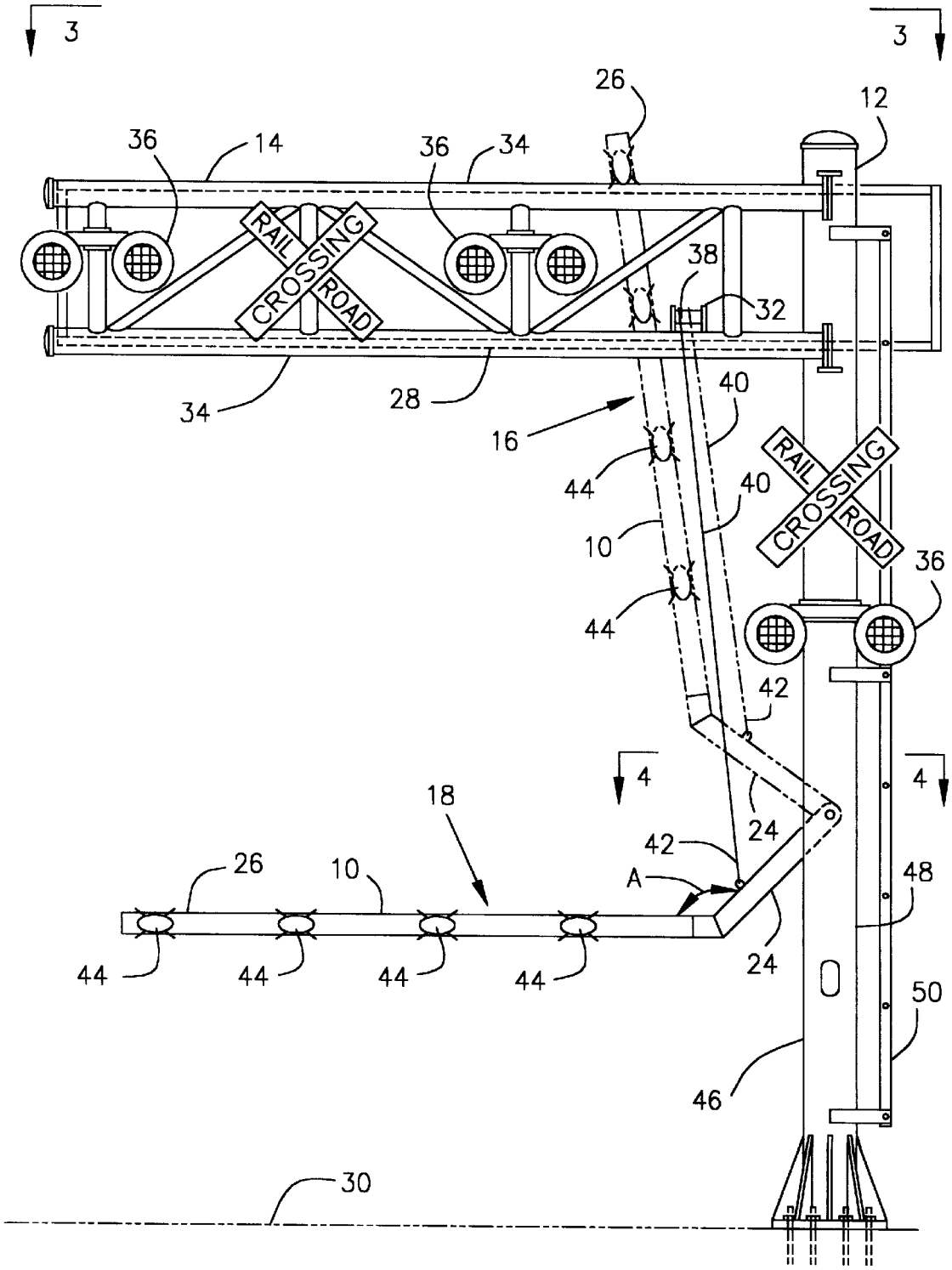
FIG. 1 is a front view of a cantilever gate arm constructed in accordance with a preferred embodiment of the present invention shown attached to a cantilever crossing structure.
Figure 3:
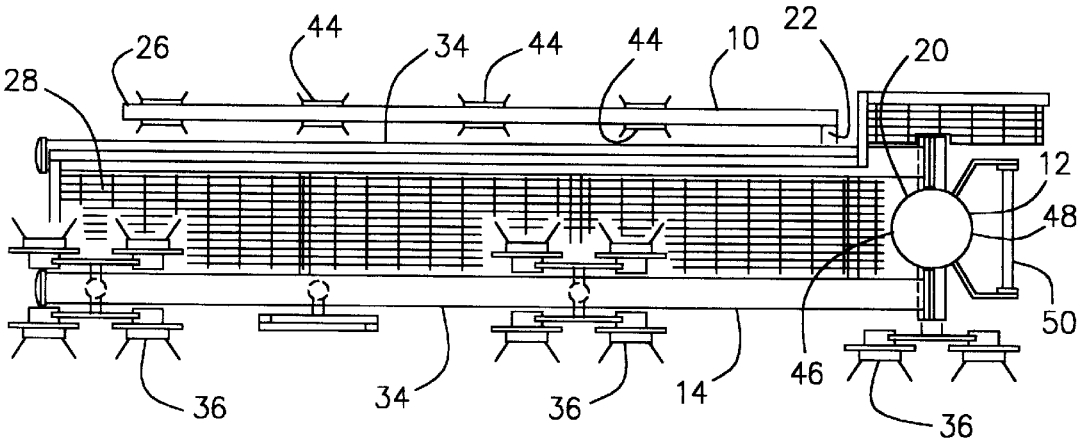
FIG. 3 is a top plan view taken along line 3—3 of FIG. 1.
Figure 4:
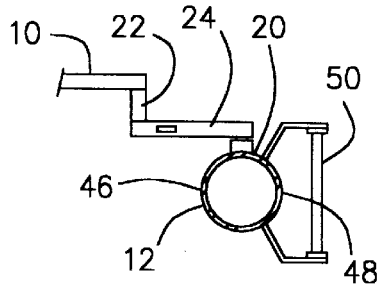
FIG. 4 is a cross sectional view taken along line 4—4 of FIG. 1.

Referring now to the drawings and initially to FIG. 1, there is illustrated a cantilever gate arm 10 constructed in accordance with a preferred embodiment of the present invention. The gate arm 10 is pivotally secured to a mast 12 of an existing cantilever crossing structure 14 so that the gate arm 10 is movable between a raised out of use position, as illustrated by numeral 16 in FIG. 1, and a lowered in use position, as illustrated by numeral 18 in FIG. 1. The gate arm 10 pivotally secures to a back side 20 of the mast 12, as illustrated in FIG. 4, and the gate arm is provided with a backward extension 22 at its proximal end 24. The backward extension 22 allows an opposite distal end 26 of the gate arm 10 to clear a catwalk 28 that is secured to the mast 12 and cantilevered over a roadway 30 when the gate arm 10 is lifted to its raised out of use position 16, as shown in FIG. 3.

A winch 32 is secured to the top of the mast 12 or one of the supporting members 34 for the catwalk 28 and is electrically connected to a control box (not illustrated) located within the mast 12 so that the winch 32 is activated and deactivated in coordination with the activation and deactivation of flashing warning lights 36 provided on the cantilever crossing structure 14. A first end 38 of a cable 40 winds around the winch 32 and unwinds from the winch 32 in response, respectively, to deactivation and activation of the winch 32. An opposite second end 42 of the cable 40 attaches to the gate arm 10. Thus, when the winch 32 is activated in response to an approaching train, the cable 40 unwinds from the winch 32 thereby lowering the gate arm 10 from its raise position 16 to its lowered position 18. Simultaneously, lights 44 provided on the gate arm 10, that are also electrically connected to a control box located within the mast 12, are activated so that they shine to warn approaching motorists that the gate arm 10 is lowered.

Likewise, when the winch 32 is deactivated in response to the passing of a train, the cable 40 rewinds onto the winch 32 thereby raising the gate arm 10 from its lowered position 18 to its raised position 16. Simultaneously, lights 44 that are provided on the gate arm 10 deactivate so that they no longer shine.

As illustrated in FIG. 1, the gate arm 10 is preferably not straight when viewed from above, but rather is provided with a straight distal end 26 that connects via the backward extension 22 to a straight proximal end 24. The distal end 26 is also preferably not aligned along a straight line with the proximal end 24 when viewed from the front. Rather the distal and proximal ends 26 and 24 form an obtuse angle with each other when viewed from the front, as illustrated by angle A in FIG. 1. The angle A allows the distal end 26 of the gate arm 10 to be parallel to the roadway 30 when the gate arm 10 is in its lowered position 18 while allowing the gate arm 10 to be removed from the line of traffic travelling on the roadway 30 when the gate arm 10 is lifted to its raised position 16.

Figure 2:
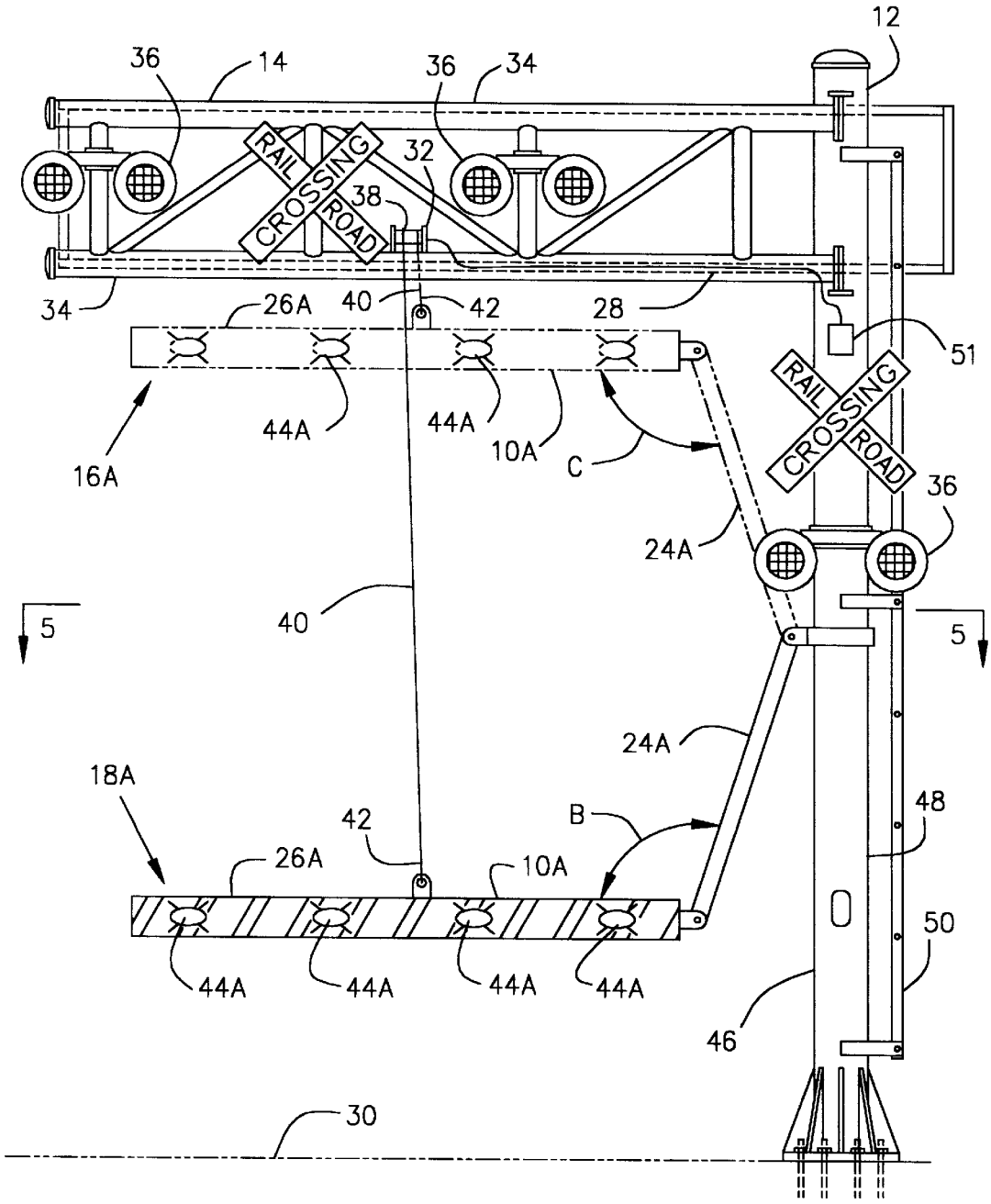
FIG. 2 is a front view of an alternate cantilever gate arm shown attached to a cantilever crossing structure.
Figure 5:
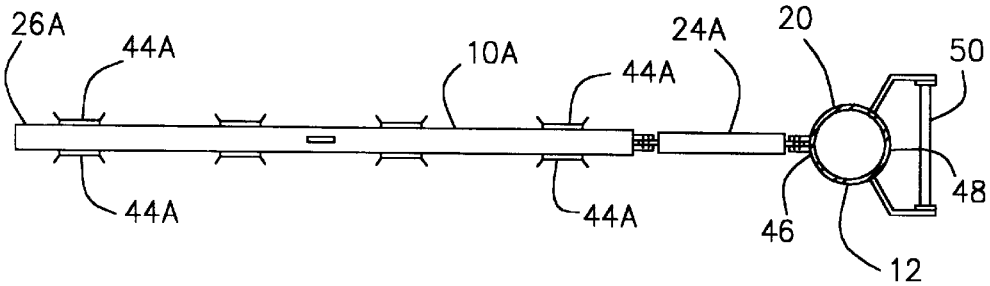
FIG. 5 is a cross sectional view taken along line 5—5 of FIG. 2.

Referring now to FIGS. 2 and 5, an alternate embodiment cantilever gate arm 10A is illustrated. The alternate gate arm 10A differs from the preferred gate arm 10 as described hereafter.

The alternate gate arm 10A pivotally secures to a side 46 of the mast 12 opposite the side 48 to which a ladder 50 for accessing the catwalk 28 of the existing cantilever crossing structure 14 attaches to the mast 12. The alternate gate arm 10 is provided with a distal end 26A that pivotally secured to a proximal end 24 also provided on the gate arm, and the proximal end 24A pivotally secures to the side 46 of the mast 12. Thus, when the alternate gate arm 10A is raised between its raised out of use position 16A and its lowered in use position 18A, the alternate gate arm 10A pivots in two places, i.e. between the two ends 26A and 24A and at the point where the proximal end 24A attaches to the mast 12. Thus, when the alternate gate arm 10A is in its lowered position 18A, the ends 26A and 24A form an obtuse angle B above them, as viewed from the front and as illustrated in FIG. 2. Also, when the alternate gate arm 10A is in its raised position 16A, the ends 26A and 24A form an obtuse angle C below them, as viewed again from the front and as illustrated in FIG. 2. The ends 26A and 24A of the alternate gate arm 10A are aligned along a straight line, as viewed from above and as illustrated in FIG. 5. The alternate gate arm 10A does not need a backward extension 22 like that provided in gate arm 10 since it does not need to clear the catwalk 28. As illustrated in FIG. 2, the alternate gate arm 10A remains below or along side the catwalk 28 in both its lowered position 18A and in its raised position 16A. In addition, in both the raised and lowered position 16A and 18A, the distal end 26A of the alternate gate arm 1A remains parallel with the roadway 30.

Like the preferred gate arm, the alternate gate arm 10A is raised and lowered by the winch 32 that is secured to one of the supporting members 34 for the catwalk 28 and is electrically connected to a control box 51 located within the mast 12 so that the winch 32 is activated and deactivated in coordination with the activation and deactivation of flashing warning lights 36 provided on the cantilever crossing structure 14. The operation of the winch 32 and the cable 40 with regard to the alternate gate arm 1A are the same as previously described in association with the preferred gate arm 10.

The alternate gate arm 10A is also provided with lights 44A that are electrically connected to a control box located within the mast 12 and that are activated so that they shine to warn approaching motorists that the alternate gate arm 10A is lowered and deactivated when the alternate gate arm 10A is raised.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A cantilever gate arm retrofitted onto an existing cantilever crossing structure that does not have a gate arm comprising:

a gate arm pivotal attached to a mast of an existing cantilever crossing structure, a winch attached to a cantilevered support member provided on the existing cantilever crossing structure, said winch provided with a retractable cable, and one end of the cable secured to said gate arm as a means for alternately lowering the gate arm to a lower in use position and for lifting the gate arm to a raised out of use position.

2. A cantilever gate arm retrofitted onto an existing cantilever crossing structure according to claim 1 wherein said winch is electrically connected to a control box provided at said mast so that said winch is activated and deactivated to alternately lower and raise said gate arm in coordination with the approach and passage of a train.

3. A cantilever gate arm retrofitted onto an existing cantilever crossing structure according to claim 2 wherein a proximal end of said gate arm pivotally attaches to the mast.

4. A cantilever gate arm retrofitted onto an existing cantilever crossing structure according to claim 3 further comprising:

a backward extension connecting a distal end of said gate arm to said proximal end of said gate arm to allow the distal end of said gate arm to clear a catwalk of the cantilever crossing structure when the gate arm is raised.

5. A cantilever gate arm retrofitted onto an existing cantilever crossing structure according to claim 4 wherein said distal end of said gate arm and said proximal end of said gate arm form an obtuse angle with each other when viewed from the front of the cantilever crossing structure.

6. A cantilever gate arm retrofitted onto an existing cantilever crossing structures according to claim 5 further comprising:

lights provided on said distal end of said gate arm, and said lights activated and deactivated in association with activation and deactivation of said winch.

7. A cantilever gate arm retrofitted onto an existing cantilever crossing structures according to claim 3 further comprising:

said proximal end of said gate arm pivotally attached to a distal end of said gate arm so that when the gate arm is raised and lowered said distal end remains approximately parallel with a roadway located under the cantilever crossing structure.

8. A cantilever gate arm retrofitted onto an existing cantilever crossing structures according to claim 7 further comprising:

lights provided on said distal end of said gate arm, and said lights activated and deactivated in association with activation and deactivation of said winch.

9. A cantilever gate arm retrofitted onto an existing cantilever crossing structure according to claim 8 wherein said cantilever gate arm remains below a catwalk of the cantilever crossing structure when the gate arm is raised.

10. A cantilever gate arm retrofitted onto an existing cantilever crossing structure that does not have a gate arm comprising:

a gate arm pivotal attached to a mast of an existing cantilever crossing structure, a winch attached to a part of said structure and above said gate arm, said winch provided with a retractable cable, and one end of the cable secured to said gate arm as a means for alternately lowering the gate arm to a lower in use position and for lifting the gate arm to a raised out of use position.

11. A cantilever gate arm retrofitted onto an existing cantilever crossing structure according to claim 10 wherein said winch is electrically connected to a control box provided at said mast so that said winch is activated and deactivated to alternately lower and raise said gate arm in coordination with the approach and passage of a train.

12. A cantilever gate arm retrofitted onto an existing cantilever crossing structure according to claim 11 wherein a proximal end of said gate arm pivotally attaches to the mast.

13. A cantilever gate arm retrofitted onto an existing cantilever crossing structure according to claim 12 further comprising:

a backward extension connecting a distal end of said gate arm to said proximal end of said gate arm to allow the distal end of said gate arm to clear a catwalk of the cantilever crossing structure when the gate arm is raised.

14. A cantilever gate arm retrofitted onto an existing cantilever crossing structure according to claim 13 wherein said distal end of said gate arm and said proximal end of said gate arm form an obtuse angle with each other when viewed from the front of the cantilever crossing structure.

15. A cantilever gate arm retrofitted onto an existing cantilever crossing structures according to claim 14 further comprising:

lights provided on said distal end of said gate arm, and said lights activated and deactivated in association with activation and deactivation of said winch.

16. A cantilever gate arm retrofitted onto an existing cantilever crossing structures according to claim 12 further comprising:

said proximal end of said gate arm pivotally attached to a distal end of said gate arm so that when the gate arm is raised and lowered said distal end remains approximately parallel with a roadway located under the cantilever crossing structure.

17. A cantilever gate arm retrofitted onto an existing cantilever crossing structures according to claim 16 further comprising:

lights provided on said distal end of said gate arm, and said lights activated and deactivated in association with activation and deactivation of said winch.

18. A cantilever gate arm retrofitted onto an existing cantilever crossing structure according to claim 17 wherein said cantilever gate arm remains below a catwalk of the cantilever crossing structure when the gate arm is raised.

* * * * *